US006067276A

United States Patent [19]

Bovay

[11] Patent Number: 6,067,276

[45] Date of Patent: May 23, 2000

[54] ELECTRIC TIMING BENCH AND CONTROL BOX FOR THE SAME

[75] Inventor: Jean-Pierre Bovay, Bienne, Switzerland

[73] Assignee: SMH Management Services AG, Biel, Switzerland

[21] Appl. No.: 09/140,402

[22] Filed: Aug. 26, 1998

[30] Foreign Application Priority Data

Sep. 5, 1997 [EP] European Pat. Off. ..... 97202727

[51] Int. Cl.[7] ..... G04F 8/00; G04F 10/00

[52] U.S. Cl. ..... 368/110; 368/113

[58] Field of Search ..... 368/107–113

[56] References Cited

U.S. PATENT DOCUMENTS 450,966 4/1891 Matthews ..... 368/110
1,146,320 7/1915 Fish ..... 368/110
3,596,103 7/1971 Matthews et al. ..... 250/221

FOREIGN PATENT DOCUMENTS 317995 1/1920 Germany .
49005 2/1910 Switzerland .

*Primary Examiner*—Vit Miska
*Attorney, Agent, or Firm*—Griffin & Szipl, P.C.

[57] ABSTRACT

An automatic, accurate and inexpensive timing bench, able to be purchased and used by any amateur. The bench consists of a conventional chronograph wristwatch (2) and a control box (1) provided with a housing (12) for the chronograph and a transparent cover (17). The box (1) further includes input ports, for receiving electric signals originating from timing cells, and electromagnets (51, 52) for automatically pressing the push buttons (8, 9) of the chronograph as a function of said input signals. As a result of auxiliary electric ports on each box, several of these boxes can be coupled in cascade to form a more complex timing bench.

11 Claims, 3 Drawing Sheets

ELECTRIC TIMING BENCH AND CONTROL BOX FOR THE SAME

Figure 1:
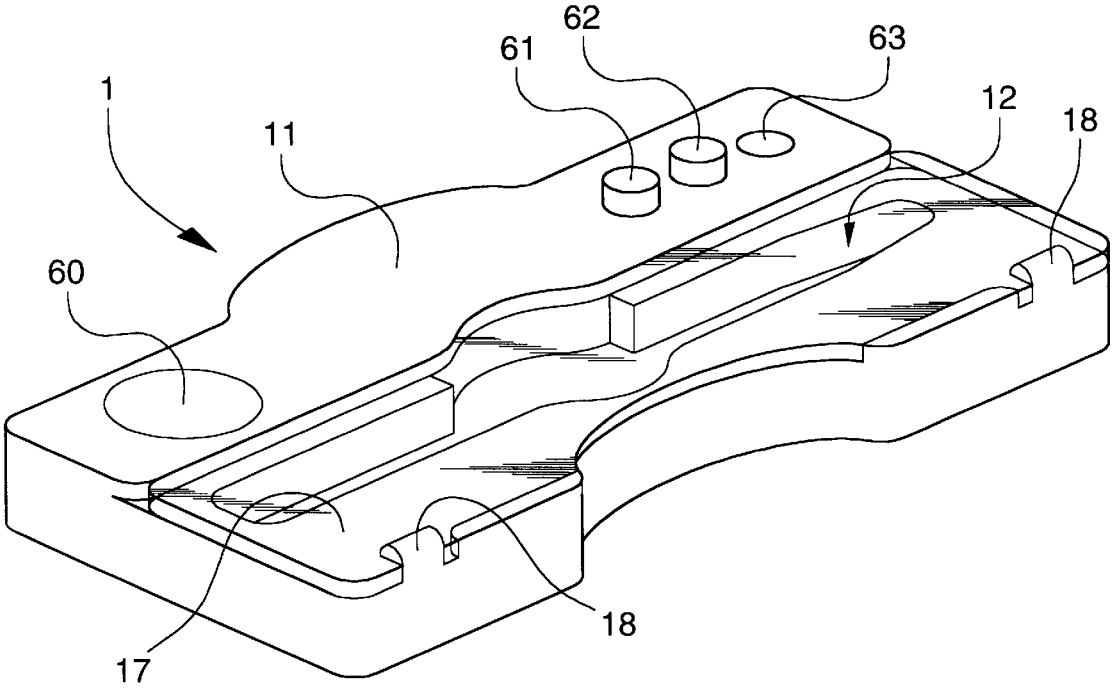

The present invention concerns an electric timing bench including a chronograph provided with at least two control elements, in particular a chronograph wristwatch having push button controls. The invention also concerns a control box able to be used in such a bench.

Currently, electronic chronographs of this kind are very widely used and are capable of measuring and displaying measured times with an accuracy of the order of a hundredth of a second. However, this accuracy is greatly reduced by the fact that an experienced user, observing the events to be timed, cannot manually actuate the push buttons with better accuracy than a tenth of a second.

This is why, in order to assure better accuracy, in particular in sports timing, manual chronographs are increasingly being replaced by timing benches remotely controlled by electric timing cells including optical sensors, pressure sensors or other similar devices. However, these timing benches are complex devices, provided with bulky and expensive data storage and processing means. An amateur sportsman cannot therefore generally use them for private use or for his daily training and has to be satisfied with using his chronograph wristwatch.

In the past, proposals have already been made to actuate mechanical chronographs from electric signals originating from detection cells, as a result of electromagnetic means acting on the push buttons of a conventional chronograph. For example, Swiss Patent No. 49005 discloses a control box provided with a support for a pocket chronograph and a device with an electric battery, electromagnets and levers for pressing one or two chronograph push buttons upon receiving the corresponding electric signals. However, this concerns a rudimentary installation which offers few functions and does not, for example, allow several successive times or the times of a several competitors to be measured as in a current timing bench.

U.S. Pat. No. 3,596,103 discloses a multiple timing installation including a row of detection cells which are each associated with a lane of an athletics track and to a respective chronograph controlled by electromechanical means. This is a fixed and heavy installation which an amateur sportsman cannot afford.

An object of the present invention is to overcome these drawbacks by creating an accurate, polyvalent, compact and inexpensive electric timing bench which can be used without difficulty by any amateur, in particular within the field of open air or indoor sports and is capable of performing time measurements according to different modes or from different signals.

According to a first aspect of the invention, an automatic electric timing bench is provided, including a chronograph provided with at least two control elements and a control box provided with a housing in which the chronograph is removably placed, the control box including input ports, for receiving electric input signals originating from cells for detecting the events to be timed, and actuating means acting on the chronograph control elements as a function of said input signals. Moreover, the control box includes auxiliary input and output electric ports arranged for connecting it to at least one other identical control box, for transmitting said input signals between said control boxes.

The control box housing can advantageously be designed to accommodate a current type of chronograph wristwatch, whose control elements are lateral push buttons. Thus, a user can use his usual chronograph wristwatch, which he simply places in the control box connected to one or more electric timing cells. Once the apparatus is set into operation, the timing can be performed automatically without any manual intervention.

According to a second aspect of the invention, a control box for an electric timing bench is provided, said box including an upper face provided with a housing arranged for removably accommodating a chronograph wristwatch having push button controls, the control box including input ports, for receiving electric input signals originating from cells for detecting the events to be timed, and electromagnets acting on the chronograph push buttons as a function of said input signals.

It is sufficient to place a current type of chronograph wristwatch in said box and to connect the box to at least one electric timing cell to form an automatic timing bench, if necessary with several of these boxes connected to each other and containing several chronographs. Moreover, such a box can form a package for the chronograph.

Figure 2:
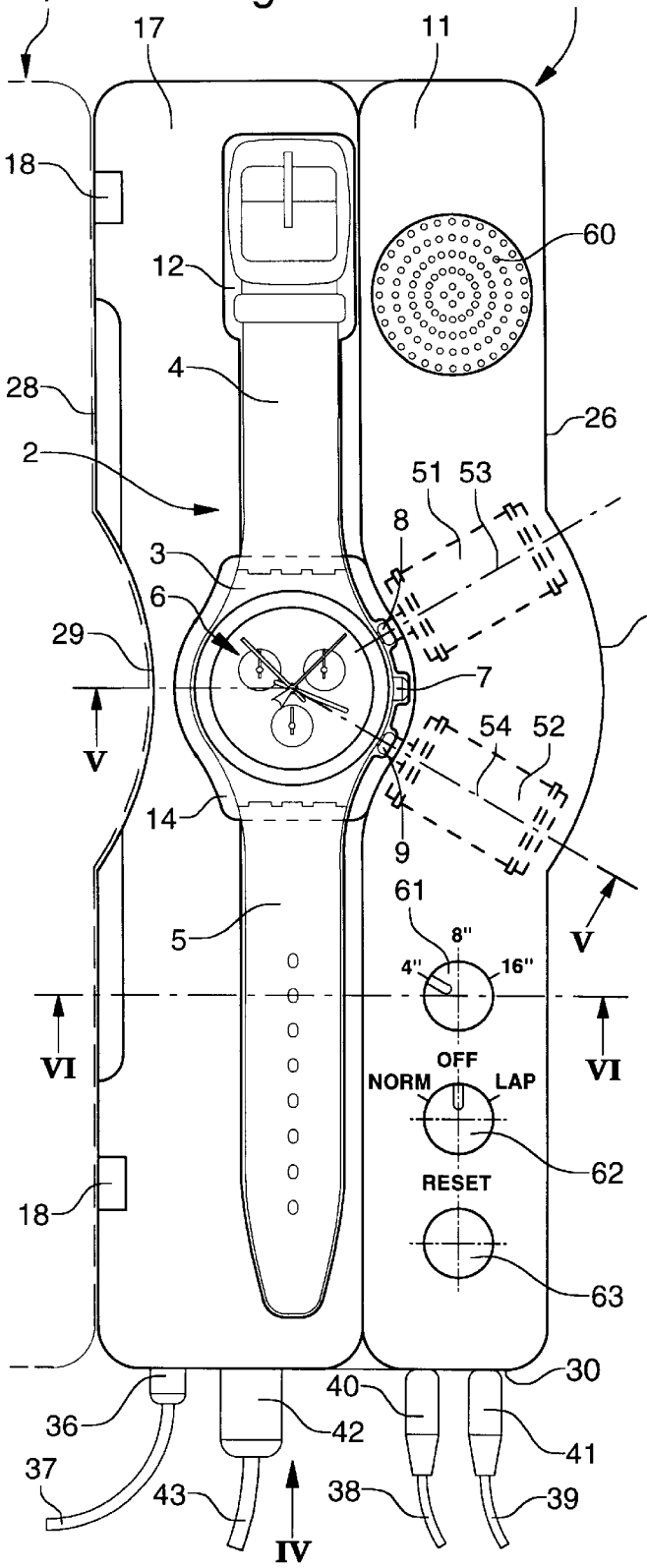
Figure 3:
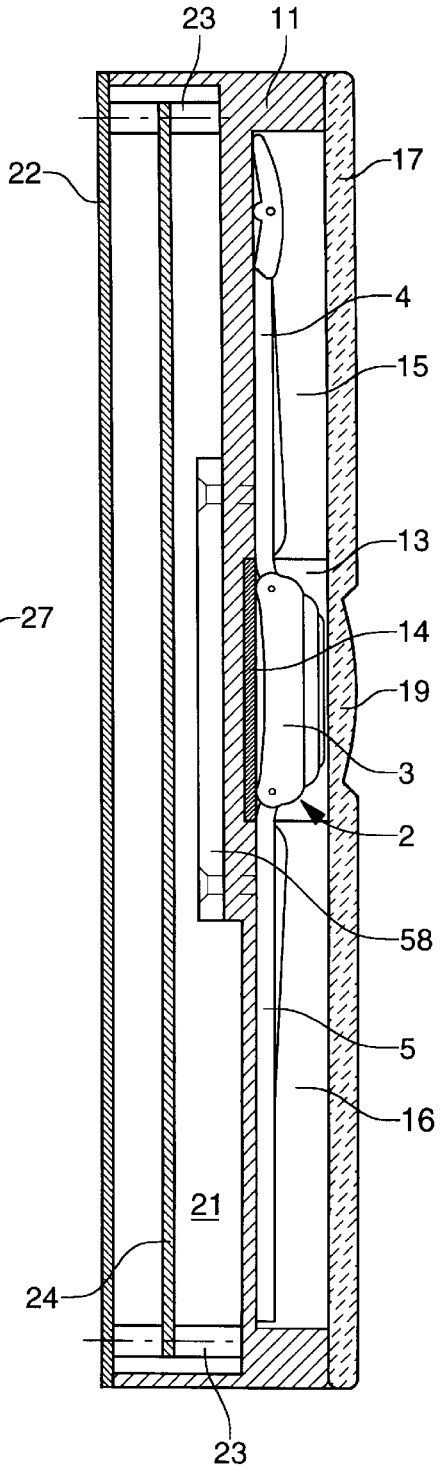
Figure 4:
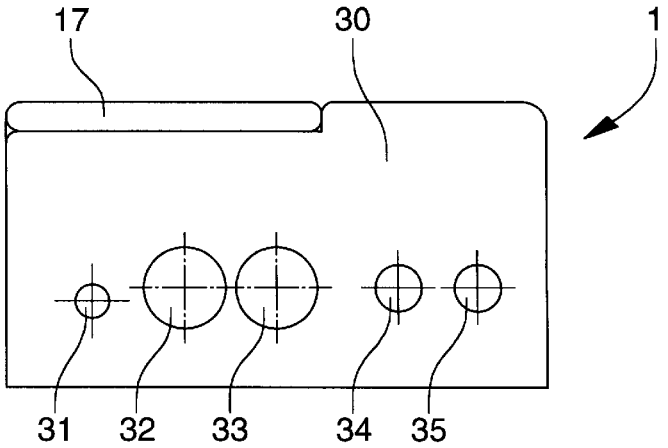
Figure 5:
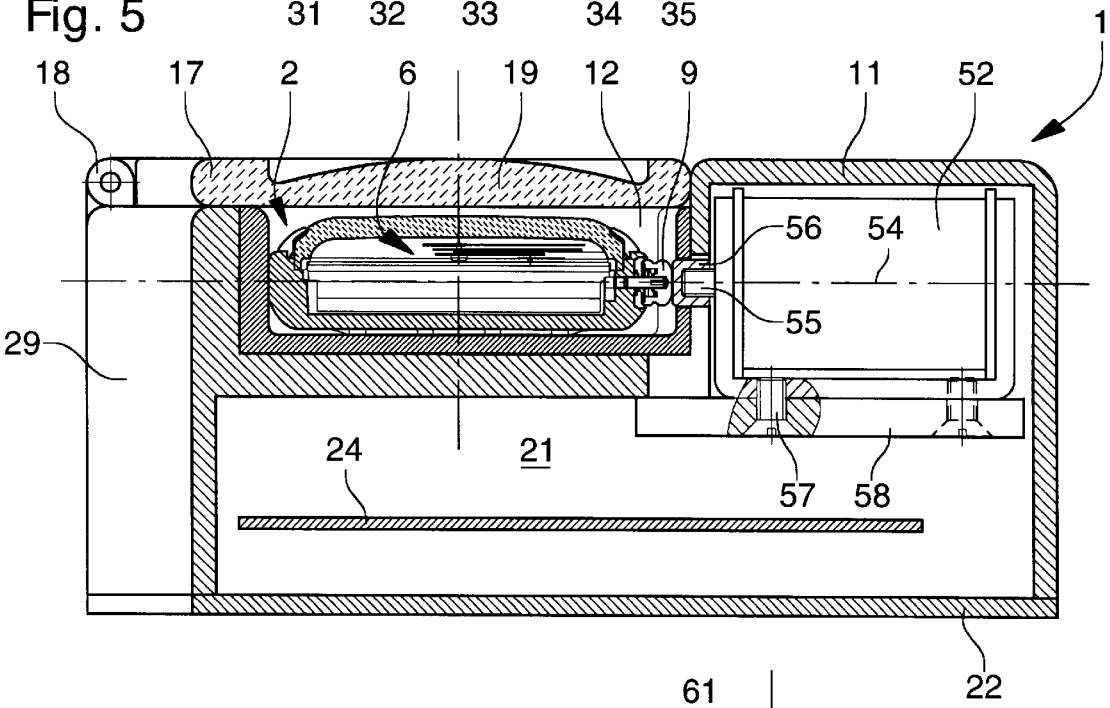
Figure 6:
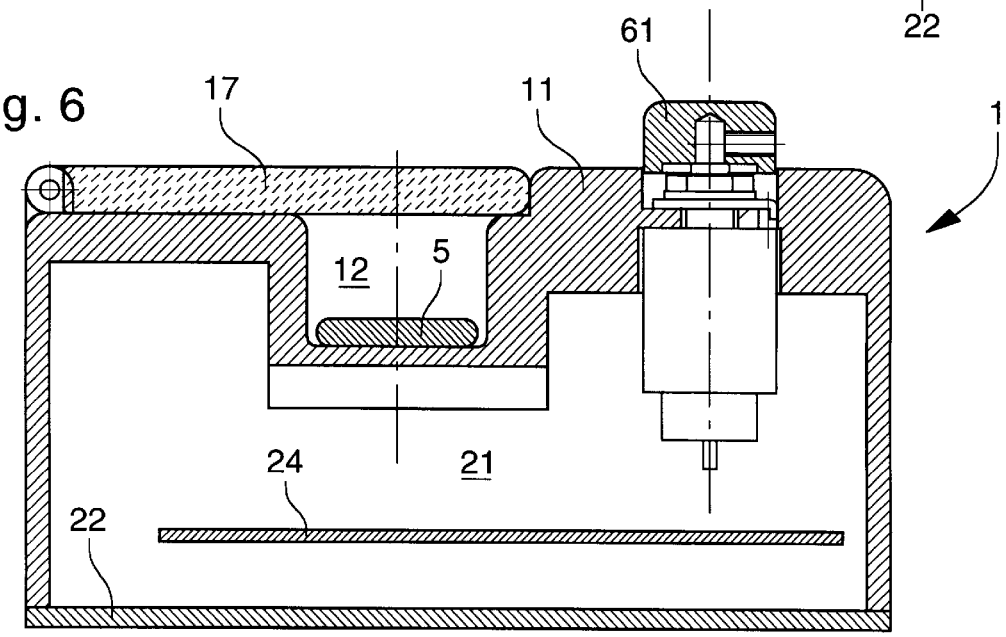

Other features and advantages of the present invention will appear in the following description of a preferred embodiment, given by way of non limiting example with reference to the annexed drawings, in which:

FIG. 1 is a general perspective view of a control box which can be used in the present invention, FIG. 2 is a top view of an electric timing bench according to the invention, including at least one control box as shown in FIG. 1, in which a current type of chronograph wristwatch having two push buttons is placed, FIG. 3 is a simplified longitudinal cross-sectional view of the timing bench of FIG. 2, FIG. 4 is a view of one end of the control box, along the arrow IV of FIG. 2, FIG. 5 is a transverse cross-sectional view along the line V—V of FIG. 2, on an enlarged scale, and FIG. 6 is a transverse cross-sectional view along the line VI—VI of FIG. 2, on an enlarged scale.

With reference to FIGS. 1 to 6, control box 1 is intended to accomodate and actuate a chronograph wristwatch 2 of a current type, including a watch case 3 and a flexible wristlet with two strands 4 and 5. Chronograph 2 is preferably a quartz chronograph; it includes display elements 6 which are analog in the present case, a time-setting crown 7 and two push buttons 8 and 9 for timing. In a conventional manner, a first application of pressure on push button 8 starts the timing (START function), a subsequent application of pressure on push button 8 stops the timing (STOP function), a first application of pressure on push button 9 when timing has started stops the display elements to allow reading of an intermediate time (LAP function), a subsequent application of pressure on push button 9 causes the display to catch up to continue to indicate the time being measured, and an application of pressure on push button 9 after stopping the timing resets the counters and corresponding display elements of the chronograph to zero. If required, chronograph 2 can also include one or more other push buttons for controlling special functions, in a known manner.

Control box 1 includes a body 11 made of molded synthetic material and having, in its upper face, a housing 12 arranged for accommodating chronograph 2. Housing 12 includes an enlarged portion 13, in which case 3 of chronograph 2 is wedged laterally by means of a pad 14, and two narrower portions 15 and 16 in which wristlet strands 5 and 6 are housed. Housing 12 is closed on the top by a cover 17 hinged by hinges 18 onto body 11 of case 1, this cover 17 allowing at least the display elements 6 of chronograph 2 to be seen. In the present case, cover 17 is made of a transparent synthetic material and has, above display elements 6, a portion in the form of a magnifying glass 19 which facilitates reading of the times displayed. Cover 17 protects chronograph 2 and holds it in its housing 12 both during use of the timing bench and for the packaging, storage, sale and transport of the assembly.

Moreover, body 11 of case 1 defines a cavity 21 intended to contain electric components. This cavity is sealed by a removable bottom 22 fixed by screws to pillars 23 which also support a printed circuit 24 in cavity 21.

As is seen in FIG. 2, control box 1 has a lateral face 26 whose central portion 27 is convex, while its opposite lateral face 28 has a concave central portion 29 of complementary shape to convex portion 27. This allows several identical control boxes 1 to be juxtaposed, as has been indicated by a second control box 1' in FIG. 2, in order to form a multiple timing bench containing several chronographs 2 which can operate independently or together, as will be described hereinafter. Control boxes 1 and 1' can include attachment means such as self-gripping strips such as Velcro®, allowing them to be attached to each other.

As is seen particularly in FIGS. 2 and 4, an end face 30 of control box 1 is fitted with five input or output ports, in this case five electric sockets 31 to 35 which are connected to printed circuit 24. Socket 31 is a supply input, intended to accommodate a bipolar connector 36 of a low voltage supply cable 37. The two sockets 34 and 35 are inputs intended to receive, via cables 38 and 39 which are fitted with connectors 40 and 41, electric input signals originating from two distinct timing cells, for example a start cell connected to socket 34 and an intermediate or finish cell, connected to socket 35. The two sockets 32 and 33 are each intended to accommodate a multipolar connector 42, for example with four poles, from a cable 43 connecting in cascade control box 1 to another identical box 1', to transmit thereto the input signals received on sockets 34 and 35. The respective chronographs of the boxes thus coupled could function together, for example by using the same signals in different ways. The two chronographs could start together upon reception of a start signal transmitted to the input of one of the control boxes.

Cavity 21 further contains two electromagnets 51 and 52 acting in the direction of their respective longitudinal axes 53 and 54 to press push buttons 8 and 9 of chronograph 2. As is seen in FIG. 5, the moving axial stem 55 of each electromagnet is fitted with a protective cap 56 capable of being applied against the push button without deteriorating it. The two electromagnets are fixed by screws 57 to a support plate 58 mounted in cavity 21. Their actuation is controlled by elements of printed circuit 24 as a function of the input signals received by one of sockets 32 to 35 and as a function of a selected operating mode of the timing bench.

The upper face of control box 1 also has, on the side of cover 17, an acoustic generator 60, a display time selector button 61, a mode selector button 62 and a reset push button 63.

Acoustic generator 60, for example of the piezoelectric type, transmits acoustic signals acknowledging the manual actuation of buttons 61 to 63.

Mode selector 62 has three positions corresponding to the following modes:

In the OFF mode, the input signals are locked. However, they can be transmitted between sockets 32 to 35 to pass from one control box to another.

In the normal mode NORM, an input signal on socket 34 generates the START function, by the action of electromagnet 51 on push button 8, and an input signal on socket 35 generates the STOP function, by action on the same push button.

The LAP mode is used for measuring and displaying intermediate times when the chronograph is working. A first input signal on socket 34 generates the START function by pressing on push button 8, then a second input signal on socket 35 generates the display of an intermediate time by pressure on the other push button 9 by electromagnet 52. This time remains displayed during a time interval determined by the user by means of selector 61 (4 seconds, 8 seconds or 16 seconds in the example shown), then the apparatus automatically effects a second application of pressure on push button 9 to continue the display of the measured time. In this mode, the STOP function cannot be effected; the user must first select the normal mode.

The reset function (RESET) of the chronograph is locked in the NORM and LAP modes. It is performed manually via pressure on button 63 when the apparatus is in the OFF mode. Electromagnet 52 then presses push button 9.

It will therefore be understood that the timing bench according to the invention can include a single control box 1 containing one chronograph 2, or several of these control boxes, containing any number of chronographs, and that these chronographs can operate simultaneously in different modes and as a function of input signals originating from different timing cells. For example, a first control box 1 can be coupled to a start cell and to a finish cell and operate in the normal mode. A second control box 1' can be coupled to the first and operate either in the normal mode, as a security measure, or in the LAP mode to display intermediate times at each passage across the finish cell. A third control box can be connected to the second, for receiving the start signal and to a third cell for measuring either another intermediate time (in the LAP mode), or another finish time.

In any configuration of the timing bench, including one or more chronographs, the bench operates automatically as soon as the operating mode or modes have been selected. It can thus be used reliably and accurately by anyone, even if the user is alone and timing his own performance.

On the other hand, control box 1 is an object of small dimensions, determined above all by the cells of chronograph 2. It is thus light, compact and can be transported in a pocket of clothes. This box constitutes an excellent protective packaging for the chronograph and can be advantageously be used for the packaging and sale of the latter. The preceding description also shows that this control box, formed of simple and inexpensive elements can be produced cheaply and purchased by any amateur. The latter can use it with a chronograph wristwatch which he already owns and which he wears on his wrist in everyday life.

Although the example described hereinbefore uses an ordinary chronograph wristwatch, actuated by pressure on its push buttons, the present invention can extend to other modes of actuating the chronograph by the control box, if these two elements are designed in an appropriate manner. For example, the push buttons could form electric contacts cooperating with contacts of the control box to receive actuation pulses. In other alternatives, the transmission of such pulses between the control box and the chronograph could be achieved by infrared rays, by hertzian waves or by an electromagnetic system. Similar transmission modes can be used between the timing cells and the control box or boxes.

What is claimed is:

1. An automatic electric timing bench, including a chronograph provided with at least two control elements and a control box provided with a housing in which said chronograph is removably placed, said control box including input ports, for receiving electric input signals originating from cells for detecting the events to be timed, and actuating means acting on the chronograph control elements as a function of said input signals, wherein said control box includes auxiliary input and output electric ports arranged for connecting it to at least one other identical control box, for transmitting said input signals between said control boxes.

2. A timing bench according to claim 1, wherein said chronograph is a chronograph wristwatch whose said control elements are lateral push buttons and said actuating means include electromagnets acting on said push buttons.

3. A timing bench according to claim 1, wherein said control box includes a manual mode selector, allowing at least two different modes for actuating said chronograph control elements to be selected.

4. A timing bench according to claim 3, wherein said control box includes a manual reset control element, arranged for generating resetting of said chronograph by said actuating means.

5. A timing bench according to claim 1, wherein said control box includes, on two opposite lateral faces, mutually complementary shapes allowing it to be joined to other identical control boxes, to form a timing bench containing several chronographs.

6. A timing bench according to claim 1, wherein said housing of the control box is closed by a cover having at least one transparent portion facing display elements of said chronograph.

7. A timing bench according to claim 6, wherein that said cover includes a magnifying glass facing said display elements.

8. A timing bench according to claim 2, wherein said housing includes an enlarged portion, formed for accommodating said chronograph case and positioning the latter with respect to said actuating elements, and at least one narrower portion formed for accommodating the wristlet.

9. A control box for an electric timing bench, said box including an upper face provided with a housing arranged for removably accommodating a chronograph wristwatch having push button controls, said control box including input ports, for receiving electric input signals originating from cells for detecting the events to be timed, and electromagnets acting on said chronograph push buttons as a function of said input signals said control box including auxiliary input and output ports arranged for connecting it to at least one other identical control box, for transmitting said input signals between said control boxes.

10. A control box according to claim 9, wherein said housing is closed by a cover having at least one transparent portion facing display elements of said chronograph wristwatch.

11. A control box according to claim 9, constituting a packaging for said chronograph wristwatch.

* * * * *